United States Patent [19]

Meisner

[11] Patent Number: 4,494,879

[45] Date of Patent: Jan. 22, 1985

[54] OPERATING ARRANGEMENT FOR AN ELECTRO-MECHANICAL CHRONOMETER

[75] Inventor: Alfred Meisner, Nuremberg, Fed. Rep. of Germany

[73] Assignee: Diehl GmbH & Co., Nuremberg, Fed. Rep. of Germany

[21] Appl. No.: 572,360

[22] Filed: Jan. 20, 1984

[30] Foreign Application Priority Data

Oct. 15, 1983 [DE] Fed. Rep. of Germany ..... 3337574

[51] Int. Cl.[3] ..... G04B 19/00; G04F 8/00

[52] U.S. Cl. ..... 368/76; 368/108; 368/228

[58] Field of Search ..... 368/76, 80, 90, 100, 368/107-113, 157, 160, 220, 225, 228; 200/38 R, 38 A, 38 FA

[56] References Cited

U.S. PATENT DOCUMENTS

| | | | |
|---|---|---|---|
| 3,568,429 | 3/1971 | Lille | 368/108 |
| 4,020,625 | 5/1977 | Mahon et al. | 368/100 |
| 4,410,774 | 10/1983 | Houpt et al. | 368/100 |
| 4,440,503 | 4/1984 | Arichi et al. | 368/107 |
| 4,440,993 | 4/1984 | Wandler et al. | 200/38 R |

*Primary Examiner*—Vit W. Miska

*Attorney, Agent, or Firm*—Scully, Scott, Murphy & Presser

[57] ABSTRACT

A driving or operating arrangement for an electro-mechanical chronometer, including an analog display having at least one indicator element, preferably for a microchronometer and/or microswitch, wherein the indicator element is driven at a rotational speed which is dependent upon the display position. An electro-mechanical transducer forming a drive element is actuated with at least one of the two pulse frequencies, through the intermediary of a switching device controlled in dependence upon the indicator positions, dependent upon the position of the analog display.

9 Claims, 5 Drawing Figures

OPERATING ARRANGEMENT FOR AN ELECTRO-MECHANICAL CHRONOMETER

BACKGROUND OF THE INVENTION

1. Field of the Invention

The present invention relates to a driving or operating arrangement for an electro-mechanical chronometer, including an analog display having at least one indicator element, preferably for a micro-chronometer and/or microswitch, wherein the indicator element is driven at a rotational speed which is dependent upon the display position.

2. Discussion of the Prior Art

Drive arrangements of this type are generally known in the technology. Thus, from the disclosure of German Pat. No. 27 11 672 there can be ascertained a mechanically-operated timing device which incorporates a quasilogarithmically expanded time scale. The foregoing is achieved in that a clock drive operates a drive mechanism at a constant driving speed, which includes two interengaging eccentric gears, of which one gear is directly fastened onto an output axle of the drive mechanism. This output axle or spindle is directly connected with a rotatable display scale which, during an operating cycle of the timing device, exhibits a rotational speed which is dependent upon the indicator position.

In this known timing device, a usual spring movement is provided for the clock drive. However, it is also possible to provide a driving arrangement of a different kind; for example, with electronic means.

Independently of the type of the driving arrangement which has been selected, there still remains the problem that, for an installation of that type it is necessary to provide a complicated drive mechanism which, moreover, must be adjusted extremely precisely. In addition thereto, it is possible to obtain only an extremely limited expansion of the time scale since, otherwise, the eccentric gears must become extremely large in size.

SUMMARY OF THE INVENTION

Accordingly, it is an object of the present invention to provide a driving or operating arrangement of that type for an electro-mechanical chronometer, in which the expansion of the time scale is not achieved through the intermediary of mechanical means. Furthermore, there is reduced the labor which is required for the adjustment of the chronometer. Additionally, the expansion range of the time scale is significantly expanded through the invention.

In order to achieve the foregoing inventive object, there has been developed an operating arrangement for an electro-mechanical chronometer, wherein an electro-mechanical transducer forming a drive element is actuated with at least one of the two pulse frequencies, by means of a switching device controlled in dependence upon the indicator position, dependent upon the position of the analog display.

In an operating arrangement of that type, it is possible in an advantageous manner, to utilize the components of usual electronic analog timepieces. Thus, a corresponding timepiece circuit need only be modified to the extent in that the juncture between a divider circuit and divider device be separated and conducted outwardly. Furthermore, different pulse frequencies must be uncoupled from the divider circuit or, alternatively, there is employed an additional multi-step frequency divider. The drive mechanism, as well as the electro-mechanical transducer, for instance a stepping motor, can be of usual construction. Preferably employable as a time-pulse generator can be an ordinary quartz oscillator.

Furthermore, there is rendered possible the utilization of simpler, mechanically or electrically scannable code elements, which can be produced extremely simply and inexpensively with a high degree of switching precision and good dependability.

When a disc-shaped analog display is employed, then for instance, the (covered) rear side can be formed as a code element through the application of suitably configured cams or electrical conductor tracks. Due to this measure, there is in particular reduced the adjustment or setting labor in an advantageous manner, inasmuch as a display distribution which is applied to the front side of the analog display can be fixedly correlated with the coding on the rear side.

A particularly advantageous configuration of the analog display is obtained when the different pulse output of the divider circuit exhibit a pulse frequency relationship of $2^3$ or a multiple thereof among each other. Obtained hereby is an approximately equally large rotational angle for one minute (basic frequency), for ten minutes (basic frequency divided by $2^3=8$), and for one hour (basic frequency divided by $2^6=64$).

BRIEF DESCRIPTION OF THE DRAWINGS

Further advantages and aovantageous embodiments can be ascertained from the following detailed description of the invention, taken in conjunction with the accompanying drawings; in which.

DETAILED DESCRIPTION

Figure 1:
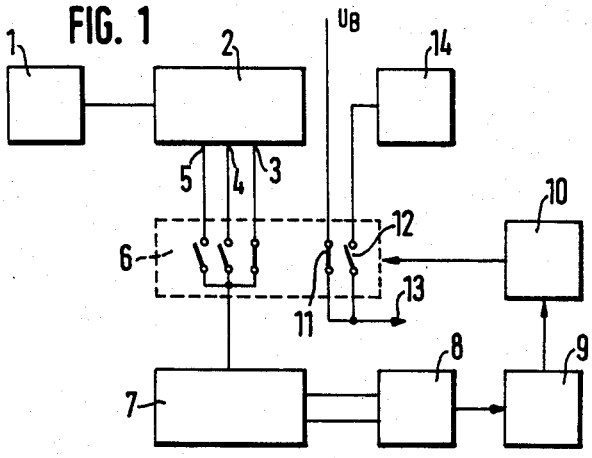
FIG. 1 illustrates a block circuit diagram for a chronometer having an operating arrangement with different output speeds.

The block circuit diagram for a chronometer as illustrated in FIG. 1 consists of a time-pulse generator 1, preferably a quartz oscillator, and a divider circuit 2 which is connected to the output thereof, and which includes at least two, preferably three pulse outputs 3, 4 and 5. The pulse outputs 3, 4 and 5 provide different pulse frequencies which preferably exhibit a pulse frequency relationship of $2^3$ or a multiple thereof. Hereby, the pulse output 3, for example, supplies a basic frequency, preferably 1 Hz, pulse output 4 thereby delivers preferably $\frac{1}{2}^3$ Hz ($\frac{1}{8}$ Hz); the pulse output 5 supplies $\frac{1}{2}^6$ Hz (1/64 Hz). The pulse outputs 3, 4, 5 are connected through a switching unit 6 with a driving device 7 for an electro-mechanical transducer 8. The electro-mechanical transducer 8, preferably a stepping motor, operates an analog display 10 through a gear reduction drive 9. The analog display 10 and/or the gear reduction drive 9, or a therewith fixedly interconnected component, in turn, control the switching device 6 in a manner whereby at least one of the pulse outputs 3, 4, 5 is connected with the driving device 7, dependent upon the display position of the analog display 10. Represented in FIG. 1 is a connection between the pulse output 3 and the driving device 7.

The switch device 6, in the preferred embodiment, can contain further switch components 11, 12, which are also controlled in dependence upon the display position. The switch component 11 hereby switches off, within a predetermined range of the display position, a supply voltage $U_B$ for the entire chronometer (in FIG. 1 there is shown the current supply to the individual components of the chronometer by means of an arrow 13). Through operation of the switch component 12, a further switch and/or signal element 14, dependent upon the position of the analog display 10, can be connected with the supply voltage $U_B$ (at an actuated chronometer). The switch and/or signal element 14, for example, can be an oscillator or a relay, which are actuated within a predetermined angular position of the analog display 10. In FIG. 1, the chronometer is shown to be actuated; in effect, the switch component 11 is closed and the switch and/or signal element 14 is deactivated by means of the switch component 12.

Figure 2:
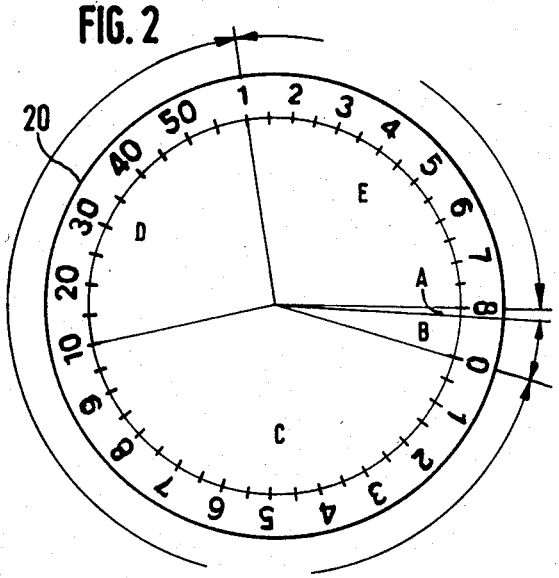
FIG. 2 schematically illustrates representation of a preferably disc-shaped analog display for a microchronometer.

FIG. 2 illustrates, in a simplified representation, a disc-shaped analog display 20 for a microchronometer, which preferably serves also as a setting element, and in a preferred embodiment is provided with a time scale in conformance with the preferred configuration shown in to FIG. 1. The disc-shaped analog display 20 is subdivided into five angular zones A, B, C, D and E.

Hereby, zone A is an extremely narrow angular zone, (preferably less than 10°) within which (with the respective angular position being a prerequisite) the microchronometer is switched off. This signifies in FIG. 1, that the switch element 11 is open in the zone A.

Region B is a further narrow angular zone (preferably 10° to 20°) which is reached after passing through the preset short time interval. Therein, for example, there can be triggered a signal generator. Correspondingly, in FIG. 1 the switch element 12 is closed and would trigger the switch and/or signal element 14. When this zone is to be passed through within a predetermined time interval (for example, so as to limit the duration of an acoustic signal) then the driving device must continue operating; meaning, that pursuant to FIG. 1 also in the zone B must one of the pulse outputs 3, 4, 5 be connected with the driving device 7.

The zone C, D and E represent the time setting area on the analog display 20. The zone C relates to the setting range of from 0 to ten minutes, zone D the setting range of from 10 minutes to 1 hour, and zone E the setting range of from 1 to 8 hours. The subdivisions within these zones C, D and E are thereby selected so that one minute in zone C, ten minutes in zone D and one hour in zone D each, respectively, require approximately the same setting angle. The precise angles are described hereinbelow connection with FIG. 3 of the drawings.

Within the zone C, the analog display 20 is operated at the basic frequency; in essence, pursuant to FIG. 1 the driving device 7 is connected with the pulse output 3 of the divider circuit 2.

Within the zone D, the analog display 20 is preferably operated at $\frac{1}{8}$ of the basic frequency; in effect, pursuant to FIG. 1 the driving device 7 is connected with the pulse output 4.

Within the zone E, the analog display 20 is preferably operated at 1/64 of the basic frequency; in effect, pursuant to FIG. 1 the driving device 7 is connected with the pulse output 5.

Figure 3:
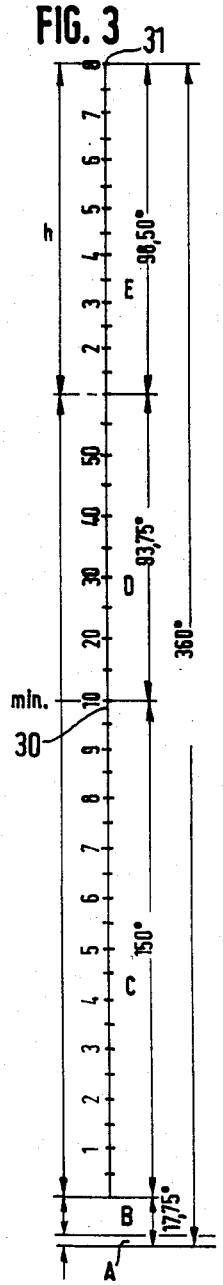
FIG. 3 illustrates a precise angle subdivision for the analog display of the microchronometer.

The exact angular zones are now elucidated hereinbelow with respect to a preferred embodiment as shown in FIG. 3 of the drawings.

In FIG. 3 the different zone A, B, C, D and E are illustrated as being linear in form. Hereby, the length of the displayed scale 30 corresponds to a rotational angle of 360°. As an example, there is assumed that the electro-mechanical transducer 80 will rotate the analog display 20 forward through an angular increment of 0.25° for each pulse step. The predetermined pulse frequency, as has already been described hereinabove, can be varied in three steps. The basic frequency consists of 1 Hz, whereas the further pulse frequencies lie at $\frac{1}{8}$ Hz and 1/64 Hz.

In a zone E beginning at one end 31 of the scale 30, which encompasses a time period of 8 hours to 1 hour, the electro-mechanical transducer 8 is operated at 1/64 Hz. Hereby the angular zone E traverses a time period of 7 hours which, for an angular increment of 0.25° for the electro-mechanical transducer, presently once for each 64 hours, corresponds to an angle of 98.5° (with precise calculation, required for 98.50° are 7 hours and 16 seconds).

Adjoining the zone E is the zone D, which encompasses a time period of 1 hour to ten minutes, in effect a length of 50 minutes. At an angular increment of 0.25°, presently once in 8 seconds, for the zone B there is obtained therefrom an angle of 93.75°.

Adjoining the zone D is the zone C, which encompasses the time period of 10 minutes to zero minutes. Within this zone, the electro-mechanical transducer is operated at a basic frequency of 1 Hz, so that for an angular increment of 0.25 per second for the electro-mechanical transducer 8, there is obtained an angle of 150° for the zone D.

For the zone B and A (designated by "Alarm" and "Off") there remains an angle of 17.75°, which can be divided pursuant to constructional needs between the zones A and B.

A chronometer as has been described hereinabove represents only one constructional embodiment for the application of the inventive operating arrangement. Thus, it is also possible to derive other timewise and spatial zonal distributions; for example, there can be provided a more extensively subdivided zone of from zero to 60 seconds, or any other number of zone for the time setting. The essential advantage obtained hereby is that the presently relative preciseness in the setting can remain approximately uniform over the entire setting range. Further application of the invention can be found, for example, in analog displays in which a completely predetermined zone should be emphasized through an expanded representation, in essence, the switching of the driving speed need not necessarily be effectuated in a sequence of increasing pulse frequencies.

Elucidated in more extensive detail hereinbelow are two preferred embodiments of the switch arrangement 6.

Figure 4:
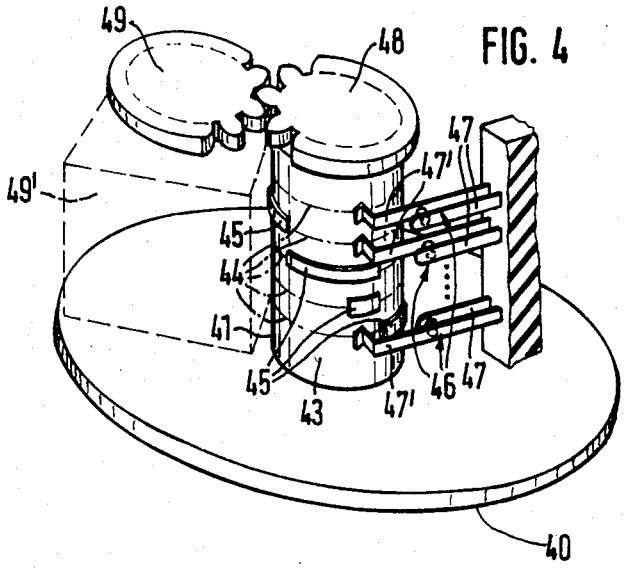
FIG. 4 illustrates a first embodiment of the code element for the speed-change mechanisms.

FIG. 4 illustrates a roller 41 which is secured against rotation on the rear side of a disc-shaped analog display 40, and which roller is constructed as a code element 42. For this purpose, the roller 41 incorporates on its annular surface 43 preferably five cam tracks 44 extending in the circumferential direction, whereby the cams 45 which are arranged on the cam tracks 44 correspond with the angular zones on the analog display 40. The cam tracks 44 are contacted by stationarily supported switches 46 (for reasons of clarity only three switches 46 are illustrated), each of which consists of a fixed contact member 47 and a resilient movable contact 47', which has its end piece presently contacting one of the tracks 44.

Hereby, the switch 46 which is located the closest to the analog display 40 is closed when contacting the annular surface 43 and is opened by means of one of the cams 45. This switch 46 would hereby correspond, for example, with the switch element 11 in FIG. 1, which switches off the current supply to the entire chronometer. The remaining switches 46 are opened when contacting the annular surface 43, and are closed by the cams 45. These switches 46 are then associated with the respective zone B, C, D and E pursuant to FIG. 2.

At the end of the roller 41 which is distant from the analog display 40 there is fastened a drive gear 48 which is in engagement with a drive output gear 49 of a schematically illustrated driving unit 49'. Hereby, the driving unit 49' preferably encompasses the control electronics for an electro-mechanical transducer, the electro-mechanical transducer and, as required, a reduction gear drive. The control electronic is then actuated through the switches 46 and operates the analog display 40 through the electro-mechanical transducer at different speeds dependent upon the angular position in conformance with the coding of the code element 42.

Figure 5:
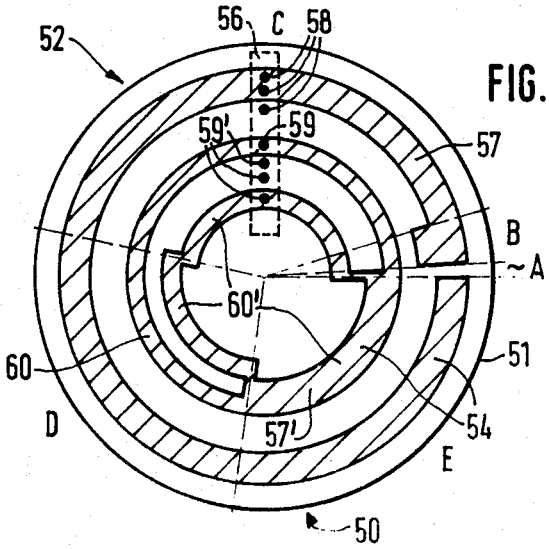
FIG. 5 illustrates another embodiment of the code element, preferably for disc-shaped analog displays.

FIG. 5 illustrates a disc 51 which is constructed as a code element 52, preferably the rear side of a disc-shaped analog display 50 which is constructed as the code element 52. The disc incorporates ring-shaped or partly ring-shaped, concentric electrical conductor paths 54, which are sensed by means of a contact bridge 56. The structural arrangement of the conductor paths 54 is hereby so designed as to coincide with the exemplary embodiment pursuant to FIG. 2; correspondingly, the disc 51 evidences five switching zones A, B, C, D and E. The conductor paths 54 consist of two, presently interdependent areas 57, 57'.

The outer area 57 hereby includes three contact tracks which are determined by means of three correspondingly located contact elements 58. The outer area 57 of the conductor paths 54 is ring-shaped and extends across the zones B to E, whereby there are presently interconnected two of the contact elemcnts 58.

This part corresponds with the switch element 11 in FIG. 1. In zone B, the third one of the contact elements 58 is also connected with the other two contact elements. This contact bridge corresponds with the switch element 12 in FIG. 1.

This inner area 57' of the conductor paths 54 serve for the switching over of the drive unit to different operating speeds, and is contacted by means of four contact elements 59, 59' along four tracks. The outermost of the contact elements 59 is conveyed along a ring-shaped closed conductor path 60 which, accordingly, extends across all zones A to E. This contact element 59, in accordance with FIG. 1, is connected with the driving device 7. The three inner contact elements 59' each presently contact one of three partially ring-shaped conductor paths 60' along three tracks and, in FIG. 1, correspond with to the parts of the switch device which is connected with the pulse outputs 3, 4, 5 (from interiorly outwardly) of the divider circuit 2. The partially ring-shaped conductor paths 60' hereby presently extend (from the outside inwardly) over the zone E (first track), over the zone D (second track) and over the zones A, B and C (third track), and are interconnected at the boundaries of the zones, and additionally with the ring-shaped, closed conductor path 60. The connections at the boundaries of the zones are represented in FIG. 5 significantly wider as they would be inactuality for reasons of drawing clarity.

Within the context of the invention it would naturally also be possible to provide a disc-shaped code element 52 with cams 45 and to correspondingly scan it electromechanically or; for example, to provide a roller-shaped code element 42 with conductor paths 54 and correspondingly scan it electrically.

Furthermore, it is also possible to provide a combination of code elements 42, 52 for the switch device 6. Preferably, the switching over of the operating speeds is accomplished by means of a code element 42, 52 with conductor paths, while the two remaining switch elements 11, 12 are designed pursuant to FIG. 1 as cam-controlled switches.

This especially has the advantage that the cam-controlled switches can be designed with switching hystereses, so that the switching-on and switching-off of the chronometer, or of alarm or switch devices can be effected in a particularly secure and precise manner.

What is claimed is:

1. In an operating arrangement for a chronometer including an analog display with at least one indicator element, such as for a microchronometer or a microswitch, wherein the indicator element is driven at a rotational speed which is dependent upon the display position; the improvement comprising an electromechanical transducer forming a driving element; and switch means controlled in dependence upon the display position operative in one of at least two different pulse frequencies, wherein said switch means actuates said transducer in dependence upon the position of the analog display.

2. Operating arrangement as claimed in claim 1, comprising a timing pulse generator; a divider circuit having at least two pulse outputs for the generation of different pulse frequencies connected to the output of said timing pulse generator; a driving means for the electromechanical transducer being selectively connected through said switch means with at least one of the pulse outputs, said switch means being actuated by said analog display.

3. Operating arrangement as claimed in claim 2, comprising a reduction gear drive connected intermediate said electro-mechanical transducer and said analog display for actuating said switch means.

4. Operating arrangement as claimed in claim 1, wherein said switch means comprises an electromechanical or electrical scanning arrangement for a code element coupled the analog display secured against rotation, said code element exhibiting a coding which is dependent upon the display position.

5. Operating arrangement as claimed in claim 4, wherein said code element comprises a disc-shaped analog display.

6. Operating arrangement as claimed in claim 4, wherein said code element comprises a disc or roller having cams arranged thereon.

7. Operating arrangement as claimed in claim 4, wherein said code element comprises a disc or roller having electrical conductor paths arranged thereon.

8. Operating arrangement as claimed in claim 2, wherein the pulse outputs of said divider circuit exhibit an integral pulse frequency relationship of $2^3$ or a multiple thereof.

9. Operating arrangement as claimed in claim 2, wherein said driving means is connected with the pulse outputs in a sequence of increasing pulse frequencies.

* * * * *